US005693259A

United States Patent [19]

Otaki

[11] Patent Number: 5,693,259

[45] Date of Patent: Dec. 2, 1997

[54] COATING COMPOSITIONS FOR GLASS SURFACES OR CATHODE RAY TUBES

[75] Inventor: Shiro Otaki, Tokyo, Japan

[73] Assignee: Acheson Industries, Inc., Port Huron, Mich.

[21] Appl. No.: 567,320

[22] Filed: Dec. 5, 1995

Related U.S. Application Data

[63] Continuation of Ser. No. 219,636, Mar. 29, 1994, abandoned, which is a continuation-in-part of Ser. No. 954,315, Sep. 30, 1992, abandoned.

[30] Foreign Application Priority Data

Oct. 4, 1991 [JP] Japan ..... 3-258061

[51] Int. Cl.[6] ..... H01B 1/14; H01B 1/18

[52] U.S. Cl. ..... 252/504; 252/506; 252/508; 252/511; 106/472; 106/474; 106/475; 313/479

[58] Field of Search ..... 252/506, 508, 252/504, 511; 106/472, 474, 475; 313/479

[56] References Cited

U.S. PATENT DOCUMENTS

| | | | |
|---|---|---|---|
| 2,699,510 | 1/1955 | Smelt | 313/83 |
| 4,052,641 | 10/1977 | Dominick et al. | 313/450 |
| 4,626,453 | 12/1986 | Klotz et al. | 427/397.7 |
| 4,791,008 | 12/1988 | Klotz et al. | 427/397.7 |
| 4,889,558 | 12/1989 | Mosser | 106/14.12 |
| 5,200,250 | 4/1993 | Tono et al. | 428/144 |
| 5,221,497 | 6/1993 | Watanabe et al. | 252/313.2 |
| 5,350,811 | 9/1994 | Ichimura et al. | 525/476 |
| 5,549,849 | 8/1996 | Namura et al. | 252/503 |

OTHER PUBLICATIONS

Grant & Hackh's Chemical Dictionary, Fifth Ed., pp. 145, 540, 1987.

*Primary Examiner*—Douglas J. McGinty
*Assistant Examiner*—Gregory R. Delcotto
*Attorney, Agent, or Firm*—Dinnin & Dunn, P.C.

[57] ABSTRACT

A cathode ray tube is coated on the inner surface with a conductive coating composition using acidic plumous alumina sol, acidic chaining silica sol, and graphite powder as raw materials; and, novel cathode ray tubes of which the inner surface is coated independently with the above, or in combination with other conductive coating agents.

6 Claims, 8 Drawing Sheets

Scanning Electron Microscopic Photograph (Magnification: 50,000) of Acidic Plumous Amorphous Alumina Sol (Alumina Sol 200)

Scanning Electron Microscopic Photograph (Magnification: 50,000) of Acidic Plumous Amorphous Alumina Sol (Alumina Sol 200)

(a)

Acidic Chaining Silica Sol
(Snowtex OUP)

(b)

Acidic Granular Silica Sol
(Snowtex O)

Scanning Electron Microscopic Photograph (x 100,000)

Results of Tape Test

Composition g, Composition h, of Table 1 and

Commercially Available High Resistance Inner Coating Agent

Comp. g Comp. h Commercially Available

Results of Tape Test

Composition c in Table 1 and Composition 1 and 1' in Table 2

Composition c

Composition 1

Composition 1'

(Reference Table 3)

(Distance Between ⊕ - ⊖ : 3 cm)

COATING COMPOSITIONS FOR GLASS SURFACES OR CATHODE RAY TUBES

This is a continuation of U.S. patent application Ser. No. 08/219,636, filed Mar. 29, 1994 now abandoned, which is a continuation-in-part of commonly assigned application Ser. No. 07/954,315, filed Sep. 30, 1992 now abandoned; and priority is claimed (35 U.S.C. §119) of Japan application No. 258,061, filed Oct. 4, 1991 in Japan.

BACKGROUND OF THE INVENTION

This invention broadly relates to providing electric conductivities to glass or other ceramics by coating their surfaces. The products of the present invention are particularly useful for coating the inner surface of the funnels of cathode ray tubes, including Braun tubes for television usage. A cathode ray tube (CRT) of a specific structure has the inner surface thereof coated with the products of the present invention; or the CRT may be coated in series with other kinds of coating compositions, together with the coating composition of this invention.

Conductive coating compositions manufactured using acidic plumous alumina sol, acidic chaining silica sol, and graphite powder have not been previously known. Although a coating composition made with acidic alumina sol or fibrous alumina hydrate having boehmite crystalline structure, granular acidic silica sol, and graphite has been contemplated, the adhesiveness required for the coating composition was not satisfactory for practical applications.

Inner surfaces of cathode ray tubes, including black-and-white and color television, which is one of the industrial application fields for this invention, are coated with inner coating compositions and neck coating compositions usually manufactured by blending potassium or sodium water glasses, graphite, and a small amount of organic dispersants; and, in certain instances silicon carbide or metallic oxides in addition to the above. Water glasses serve for adhering the above components to each other and for gluing the dried film to the glass surface.

DESCRIPTION OF PRIOR ART

It is important to note that the present invention by Applicant does not require (nor utilize) melting and fusing of the coating material to the substrate. Smelt U.S. Pat. No. 2,699,510 teaches a coating composition which is formed by melting an enamel and graphite admixture on to an iron cone. Smelt does not disclose usage of an acidic alumina sol in his coating nor does he disclose the usage of an acidic silica sol in his coating composition. In addition, Smelt makes no disclosure of any fluid carrier medium, and the Smelt disclosure does not disclose any viscosity range for his coating composition, which is another clear distinction from Applicant's invention herein. Applicant's coatings are applied by baking at approximately 430° C.; whereas the ceramic enamel coating of Smelt is applied at a temperature of 1100° C. (see his col. 2, line 9) which would destroy or chemically convert the presence of any solid alumina as present initially in Smelt. In addition, application of a coating at 800°–1100° C. as taught in Smelt would destroy the glass CRT tube to which Applicant's coating is typically applied. By definition, an enamel composition is a glass-like substance which is melted and then cooled to make a smooth hard surface. This is the type of enamel composition being referred to in Smelt, wherein the enamel is fused at an extremely high temperature of approximately 800° C. to about 1100° C. to form the coating on the iron surface referred to in the Smelt patent. This is completely different and disadvantageous relative to the type of coating application being made by Applicant wherein such high temperatures are never used. Also, usage of the teachings in Smelt would destroy the morphology and the chemical integrity of the coating (particularly the plumous alumina sol particles and/or the chaining silica sol particles) described in Applicant's invention.

Watanabe et al. U.S. Pat. No. 5,221,497 discloses an acidic silica sol, however there is no disclosure in Watanabe that his silica sol should be used in conjunction with graphite. Nor is there any teaching in Watanabe's patent that his composition includes an acidic plumous alumina sol of the type described in Applicant's invention, nor of the unique properties obtained with Applicant's coating. The Applicant's specific usage of the acidic plumous alumina sol component includes a specified particle thickness range of about 20 to 100 millimicrons and a specific length requirement for the alumina sol particles within the range of about 200 to 500 millimicrons, none of which is disclosed in Watanabe et al.

Points At Issue The Invention Is Directed To Resolving

Drying or dehydration is a rather time-consuming process if water glass is used as the base material due to its physical and chemical properties and structure. Trace quantifies of water, or of decomposition gases of organic dispersants, may be emitted after sealing the electron gun body structure (i.e., after the installation of the electron gun) or during the baking in a vacuum when manufacturing a Braun tube at a later date, and this shortens the lives of the Braun tubes. Such gases, including water molecules in the funnel, become an extremely serious problem. Accordingly, care must be taken for removing such gases by absorbing them from the surface of such a coating.

SUMMARY OF THE INVENTION

The conductive coatings of the present invention reduce or eliminate the need for alkali metal silicates, compositions to promote colloidal stability, and other organic additives such as polymeric binders; all of which can give rise to evolution of detrimental gases during or after the leahring cycle. A conductive coating manufactured using acidic granular alumina sol, acidic granular silica sol, and graphite is somewhat weak in respect to the mutual adhesiveness of the components and adhesiveness to the substrate, glass surface, for instance, after baking. In the present invention, however, it has been discovered that by use of the conductive coating compositions made by the use of acidic plumous alumina sol manufactured according to a special method independently, or by use of the above, and acidic chaining silica sol manufactured according to a special method together, provides unexpected and excellent properties. In many cases organic dispersants become unnecessary, unlike conventional water glass-based coating compositions, and no decomposition gases are generated. Such coating compositions are easy to dry, with very little gases including $H_2O$ being evolved, which are the products of decomposition (in the case of a cathode ray tube) after the tube is sealed. The adhesion of the component materials and the adhesion of the baked film to a glass surface are quite satisfactory. Therefore, the time for drying is shortened, the consumption of barium getter is minimized, the aging time is shortened or becomes unnecessary, the manufacturing cost of the cathode ray tube is lowered, and the life of the cathode ray tube becomes considerably longer.

BRIEF DESCRIPTION OF THE DRAWING FIGURES

Acidic Amorphous Plumous Alumina Sol

Figure 1:
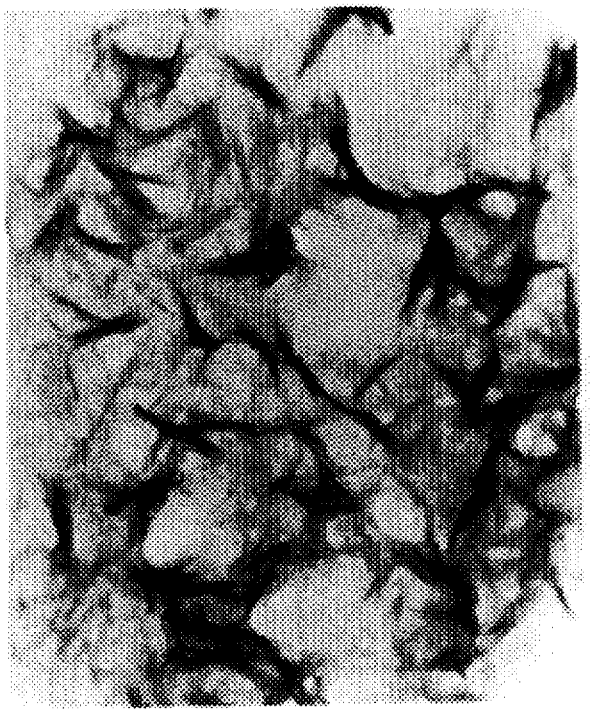
FIG. 1 illustrates a scanning electron microscope photo (magnification: 50,000) of acidic plumous amorphous alumina sol (Alumina Sol 200).

Previously there was an example of manufacturing a special coating composition using acidic alumina sol and colloidal graphite, i.e., in the Publication of Japan Patent Application Sho-38-7214, a water dispersion of fibrous alumina hydrate having boehmite crystal structure and amorphous carbon black was made. It was reported that a conductive film was made by applying this on pyrex glass and by baking it at 400° or 500° C. However, that patent did not refer to any specific industrial application of it. According to the test results of the present invention, the mutual adhesiveness of the components after baking and the adhesiveness of the baked film to the substrate (glass surface for instance) were found very poor and unsatisfactory, when such a fibrous alumina hydrate and carbon black or graphite powders were used. This was conveniently tested by the tape test which will be explained hereinbelow. That is to say, a part of the baked film came off on the adhesive tape. Similar results were obtained when granular or filamentous alumina sol was used. The tape test result was, however, discovered to be unexpectedly good when amorphous plumous alumina sol, according to the present invention, was employed. It was significantly better than commercially available inner coatings in which water glass was used as the binder. Examples of such alumina sol are: Alumina Sol 100 (Acidified with hydrochloric acid) and Alumina Sol 200 (acidified with acetic acid) of Nissan Chemical Industries, Ltd. A scanning microscopic photograph (magnification: 50,000) of Alumina Sol 200 after being dried is shown in FIG. 1.

In accordance with this invention the acidic plumous alumina sol may be broadly defined as an aqueous sol comprised of amorphous alumina particles having a thickness within the range of about 20 to about 100 millimicrons and the length of said alumina particles being within the range of about 200 to about 500 millimicrons.

More specifically, said alumina particles in one preferred embodiment, have uniform thickness within the range of 40–100 millimicrons and said particles have uniform lengths which are 5–10 times said thickness and are in the range of 200–500 millimicrons. In another preferred embodiment, said alumina particles have a uniform length in the range of about 200–500 millimicrons and a variable thickness in the range of about 20–100 millimicrons. A further description and the technique of preparation for these acidic plumous alumina sol materials is set forth in Nissan Chemical Industries, Ltd. patents: Japan patent No. 24,823 (filed Jul. 23, 1991 and published Feb. 2, 1993) and Japan patent No. 24,824 (filed 24, 1991 and published Feb. 2, 1993), the disclosures of which are incorporated herein by reference.

Acidic Chaining Silica Sol

Figure 2:
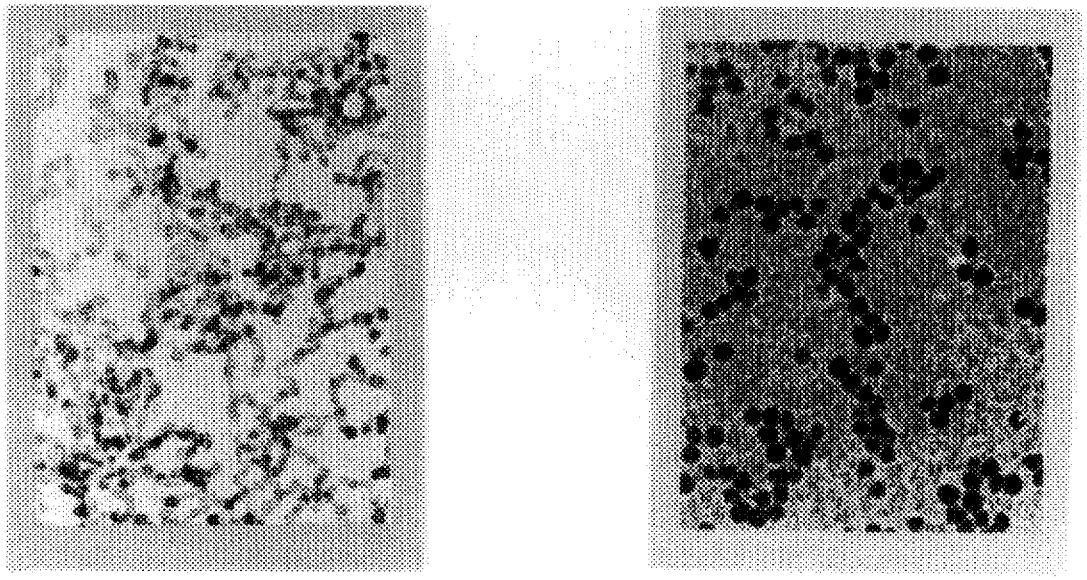
FIG. 2 shows the scanning electron microscope photos (magnification: approximately 110,000) of acidic chaining silica sol (Snowtex OUP) and acidic granular silica sol (Snowtex O).

Inner coatings with a range of electric resistivity are needed in the cathode ray tube manufacturing industry. In the color television industry, an internal funnel coating having an electric resistance at 0.05–0.20 ohms-cm is called an ordinary resistance coating and an inner funnel coating having an electric resistance at 0.20–0.50 ohms-cm, for instance, is called a high resistance or soft flash inner funnel coat. The result of the tape test on a coated product containing a coating of graphite and amorphous plumous alumina sol was unsatisfactory in the region of low to ordinary electric resistance. It was because of a low pigment ratio, alumina/graphite. Various methods were tested to improve the situation and it was unexpectedly discovered that the addition of acidic chaining silica sol was effective. The addition of granular silica sol did not improve the tape test. Snowtex OUP of Nissan Chemical Industries, Ltd. is available as an example of such acidic chaining silica sols. The scanning electron microscopic photograph (magnification: about 110,000) is shown in FIG. 2. For reference, the scanning electron microscopic photograph of the same magnification of Snowtex O of Nissan Chemical Industries, Ltd. is also shown in FIG. 2 as an example of acidic granular silica sol.

Acceptable results of the tape test are obtained in the high electric resistance side of 0.3–8.5 ohms-cm with the exclusive use of acidic plumous alumina sol.

In accordance with this invention, the acidic chaining silica sol can be defined as having an $SiO_2$ concentration of ½% to 40% by weight (preferably 1% to 35%), with the sol containing amorphous colloidal silica particles dispersed in a liquid medium, and the shape of the particles is characterized in that the particles each has a particle size of from 40 to 500 millimicrons as measured by dynamic light-scattering method,* and when observed with an electronic microscope, each have an elongated chain-like shape elongated in only one plane and having a uniform thickness in the direction of elongation within the range of from about 5 to about 40 millimicrons. This type of chaining silica sol is described in Watanabe et al U.S. Pat. No. 5,221,497 (assigned to Nissan Chemical Industries, Ltd.) the disclosure of which is incorporated herein by reference.

*This method is described in the "Journal of Chemical Physics", Vol. 57, No. 11 (Dec. 1972), page 4814.

Coating In Series With High Scratch Hardness Neck Coating Compositions Or With Other High Resistance Coating Compositions Containing Powders Of Silicon Carbide, Silicates or Metallic Oxides The electron gun holding structures are inserted into the neck of a cathode ray tube. A high scratch hardness is required for a neck coating to avoid particles being dislodged during the insertion of the electron gun. Conventional neck coatings are satisfactory in this respect due to water glass that is contained therein. The drying rates of the coating compositions, in which water glass is employed as binder, are low. Therefore, a noticeable amount of moisture of other gaseous materials are generated. However, this is not a serious problem in practice, as only a small amount of neck coating is employed. Therefore, it is proposed that use of such a neck coating and an inner coating composition of the present invention may be used together on the internal surface of the funnel for a CRT.

It was discovered that various coating compositions for the neck coating and the inner coating composition of this invention were compatible with each other when they were coated in series. Details are presented in Experiment 3 below.

A Method Of Coating In Series With High Scratch Hardness Neck Coating Compositions Or With Other High Resistance Coating Compositions Containing Alkali Metal Water Glass And Powders Of Silica Carbide, Silicates Or Metallic Oxides Alkali metal water glass is the base for the neck coating compositions (or a high resistance coating composition as described above), and these compositions are alkaline. Alumina sol and silica sol of the present invention are acidic. When these neck coating compositions (or high resistance coating compositions) and the coating compositions of the present invention are brought into contact in a wet state, alkali silicates may coagulate and the two coating compositions may not adhere to each other when they are dried. In such cases, the coating compositions of the present invention can be applied to the surface of ceramics or glass substrate, and they are heated to dry and to drive off the acids (such as acetic or hydrochloric acid) which are contained in the coating compositions of the present invention. Then the coating compositions comprising alkali metal water glass can be applied in series overlapping the former. They then become compatible and a satisfactory result of tape test of the overlapping area is obtained.

Examples Of Manufacturing Coating Compositions

Manufacturing Example 1

| Raw Materials | % By Weight |
|---|---|
| Graphite Powder [e.g., Acheson Colloiden, #09UF2(FC)] | 8.96 |
| Alumina Sol 200 (Solid Content: 10%) [acidic plumous amorphous alumina sol (see FIG. 1)] | 89.39 |
| Deionized Water | 1.65 |
| | 100.00 |

(The above raw materials are charged into a pebble mill and rolled for 15–30 hours at 120 r.p.m.)

Manufacturing Example 2

| Raw Materials | % By Weight |
|---|---|
| Graphite Powder [09UF2(FC)] | 15.0 |
| Alumina Sol 200 (Solid Content: 10%) | 55.0 |
| Snowtex OUP (Solid Content: 15%) | 30.0 |
| (Acidic Chaining Silica Sol) | |
| | 100.00 |

Test Method (1) Viscosity measurement
B type revolution viscometer of Tokyo Keiki Company
(2) Tape test
Nichiban Cello-tape No. 405

(The above raw materials are charged into a pebble mill and rolled for 15–30 hours at 120 r.p.m.)

An internal coating dispersion was brush-applied onto a glass panel 6 cm×15 cm, dried at 150° C. for 30 minutes and then baked at 430° C. for 1 hour. The tape test was carried out after cooling to room temperature.

Coating Method

Spraying, brush coating, sponge coating, and flowing method can be used to apply electric resistance or high electric resistance inner coating compositions related to this invention.

Examples Of the Experiments Showing The Excellencies Of This Invention

Experiment 1

Dosages Of Acidic Plumous Alumina Sol and Electric Resistances

Figure 3:
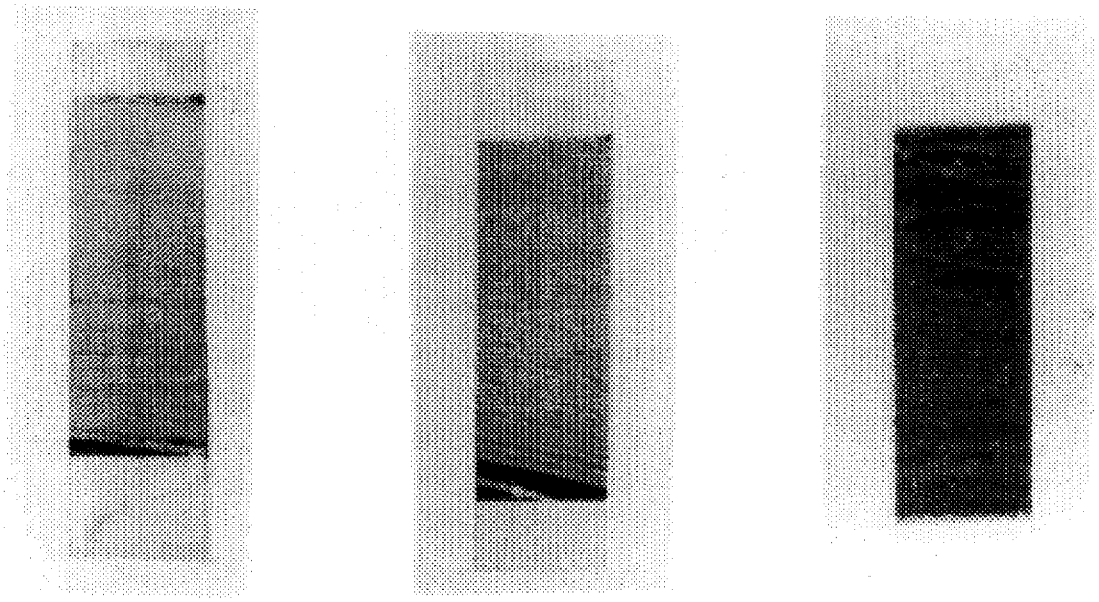
FIG. 3 illustrates the results of a tape test of Compositions g and h in FIG. 3 and a commercially available high resistance internal coating.

The amount of nonconductive materials to be added to the inner coating compositions for funnels for changing the electrical resistances are expressed by the weight ratios with graphite in general. A plumous alumina sol functions not only as an adhesive but also as a conductivity adjustment composition for graphite films. The relations between ratios of [alumina sol (solid)/graphite] and electric conductivities are shown in Table 1. The results of the tape test of Composition g and h are shown in FIG. 3. The excellencies in comparison with the commercially available high resistance inner coating compositions are readily apparent.

Experiment 2

Combined Use of Acidic Chaining Silica Sol

Figure 4:
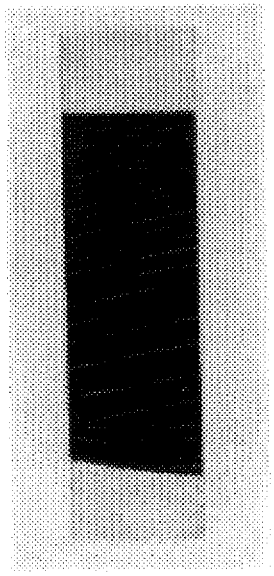
FIG. 4 shows the results of a tape test of Composition c in Table 1 and Compositions 1 an l' in Table 2.
Figure 4:
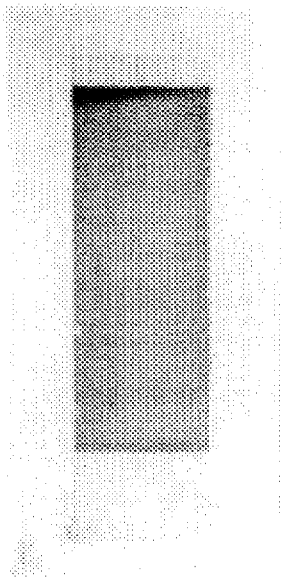
Figure 4:
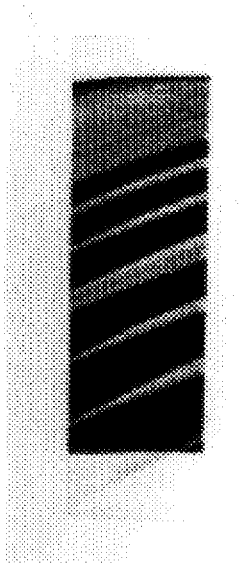

The adhesiveness attained by the exclusive use of acidic plumous amorphous alumina sol is somewhat insufficient in the low electric resistance region of 0.28–0.38 ohms-cm as shown in Table 1 (Composition c in Table 4 and Composition c in Table 1). This is because of the low concentration of alumina sol (as solid) relative to graphite (pigment ratio). It was found that satisfactory tape test results were obtainable by the addition of acidic chaining silica sol together in this region. Refer to the Composition l in FIG. 4. Unacceptable tape test results are obtained if the same amount (as solid) of ordinary granular silica sol Snowtex O is used instead. Refer to Composition l' in FIG. 4. Similarly, although the tape test result of Composition k is acceptable, that of k' is unacceptable. Properties and compositions of k, k', l, and l' are shown in Table 2.

Experiment 3

Compatibilities With Generally Used Water Glass Based Neck Coating Compositions Compatibilities between the inner coating compositions manufactured by using graphite and acidic plumous amorphous alumina sol or by using acidic chaining silica sol together and ordinary water glass based neck coating compositions were tested by coating those in series.

Figure 5:
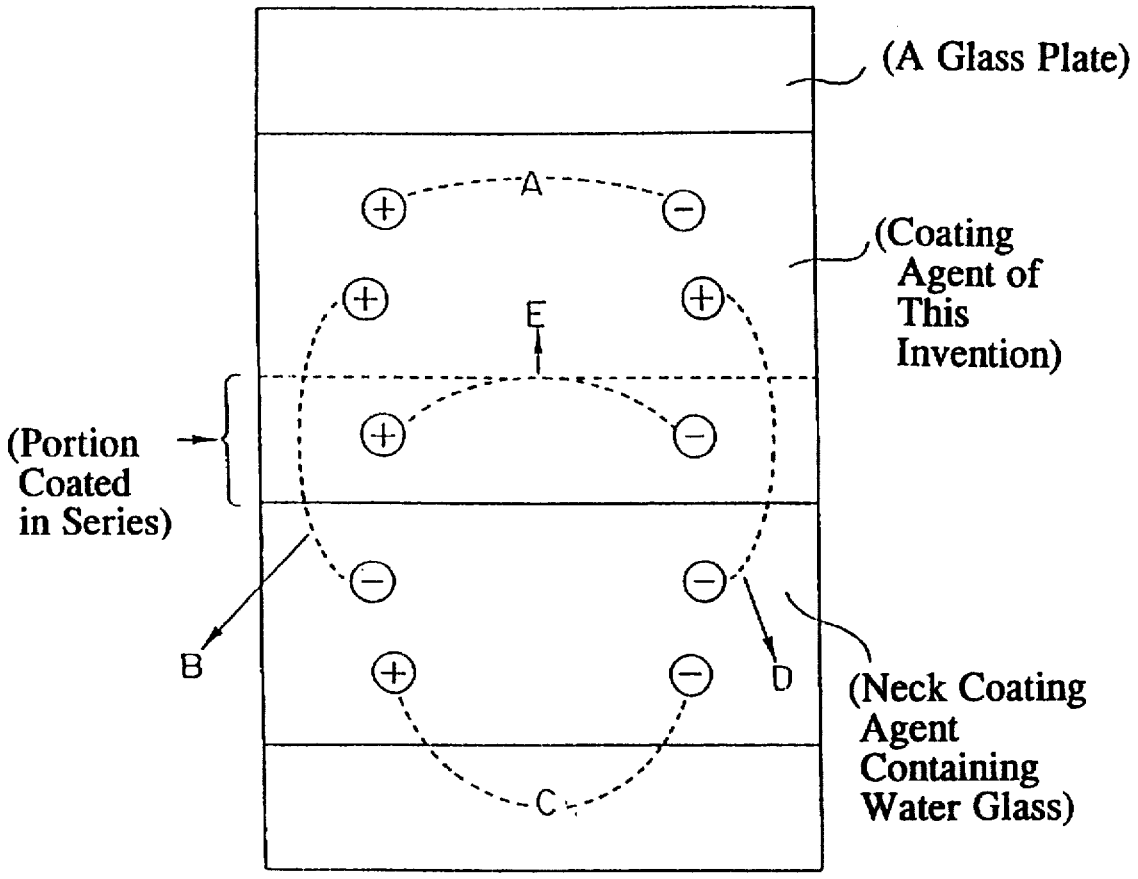
FIG. 5 shows the values of electric resistance at various representative positions over a water glass based neck coating and an electro-conductive coating composition of the present invention overlapping the former, both of which were baked at 430° C.

As shown in FIG. 5, the neck coating composition was applied on a glass surface with brush, dried in air, then the coating composition of this invention was coated with a brush in series, baked for one hour at 430° C., and the electric resistances were measured between two points 3 cm apart. The overlapping area formed a continuous matrix and this was proven by the test values of the electric resistances. (Table 3).

The compositions of so-called soft flash inner coating compositions consisting of water glass, graphite, silicon carbide and metallic oxides for increasing the electric resistance are similar to that of the above neck coating composition, and would indicate good compatibility similar to the coating composition of this invention.

Experiment 4

Coating Method To Ensure A Stronger Adhesion Between An Electroconductive Coating Composition Of The Present Invention And A Water Glass Based Electroconductive Coating Composition In order to ensure a stronger adhesion between an electroconductive coating composition of the present invention and a water glass based electroconductive coating composition with or without silicon carbide or metallic oxide powders, the former was applied on a glass surface or on a surface of a ceramic substrate first and was heated to dry and to remove acid(s) such as hydrochloric or acetic acid making the coat neutral and a water glass based electroconductive coating composition was applied in series. After baking at 430° C., the adhesion between the two became quite satisfactory to meet the industrial requirement.

Experiment 5

Measurements Of Degasification Rates Including Release Of Water Molecules By Using Thermogravimetric Analysis And Amount Of Gases Generated The coated funnel is dried in air and it is baked under vacuum in the case of cathode ray tubes. Organics such as a dispersant and a thickener must be removed this way.

Drying rates and the amounts of gas generation of the water glass based coating compositions for inner coating and the coating compositions of this invention were obtained by simulating those processes as follows.

Test Method

Thermogravimetric Analysis (TGA): SEIKO I SSC-5000

A dispersion solution of coating composition is taken in an aluminum dish, is predried for 60 minutes at 120° C., and is crushed in an agate mortar.

Figure 6:
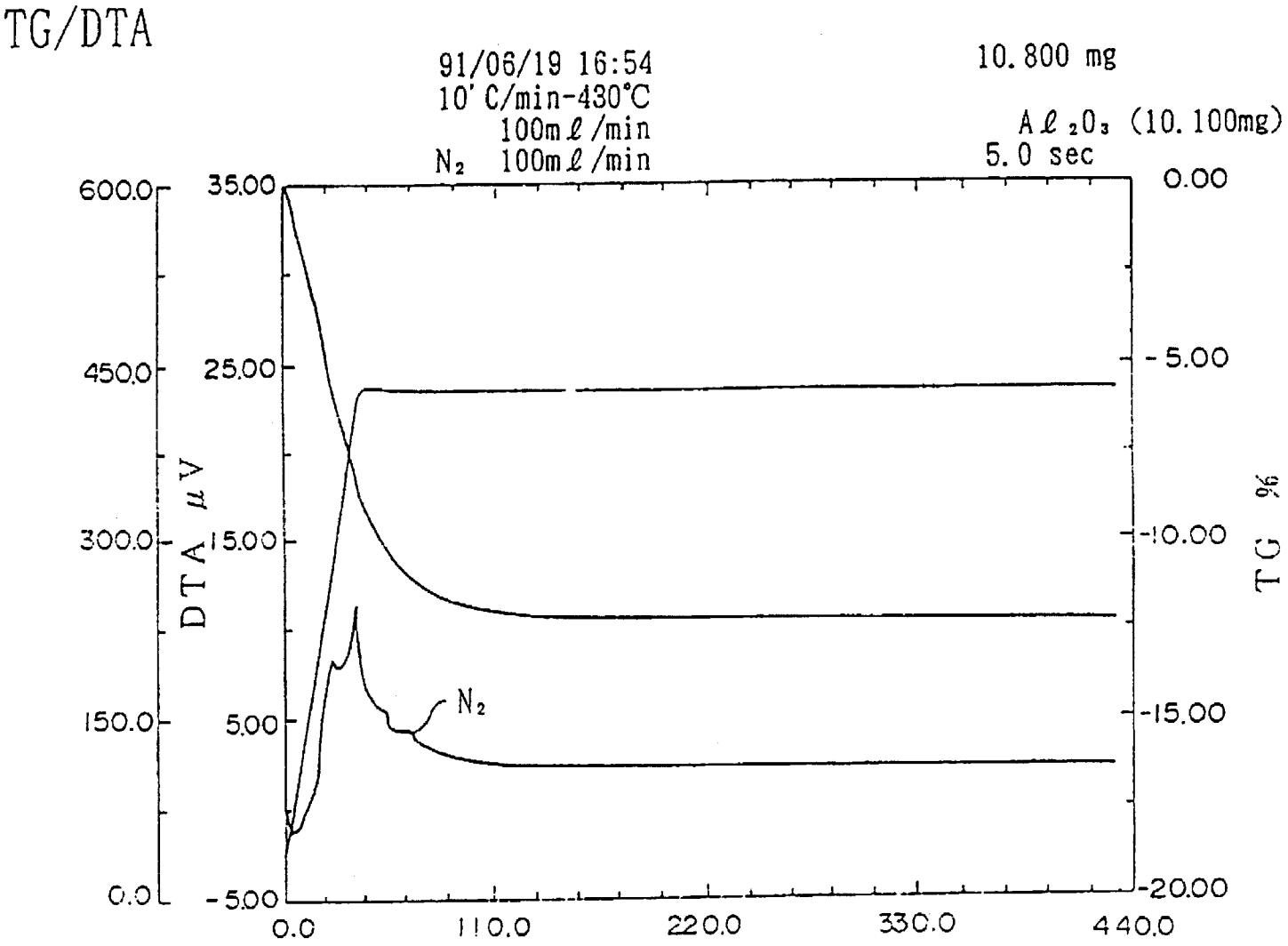
FIG. 6 shows the rates of degasification or the rates of gas evolution, determined by thermo-gravimetric analysis, of a commercially available normal resistance internal coating (A).

About 10 mg of the sample is taken in the sample chamber, and the temperature of the same chamber is raised to 430° C. at the rate of 10° C./min. Dry air is passed at the rate of 100 cc/min. When the temperature reached 430° C., the test is continued at the constant temperature of 430° C. for 30 minutes. Dried air is switched to nitrogen gas flow (100 cc/min). The test is continued for six hours thereafter. Obtained results are shown in FIG. 6. Table 4 summarizes the results in numbers.

Figure 7:
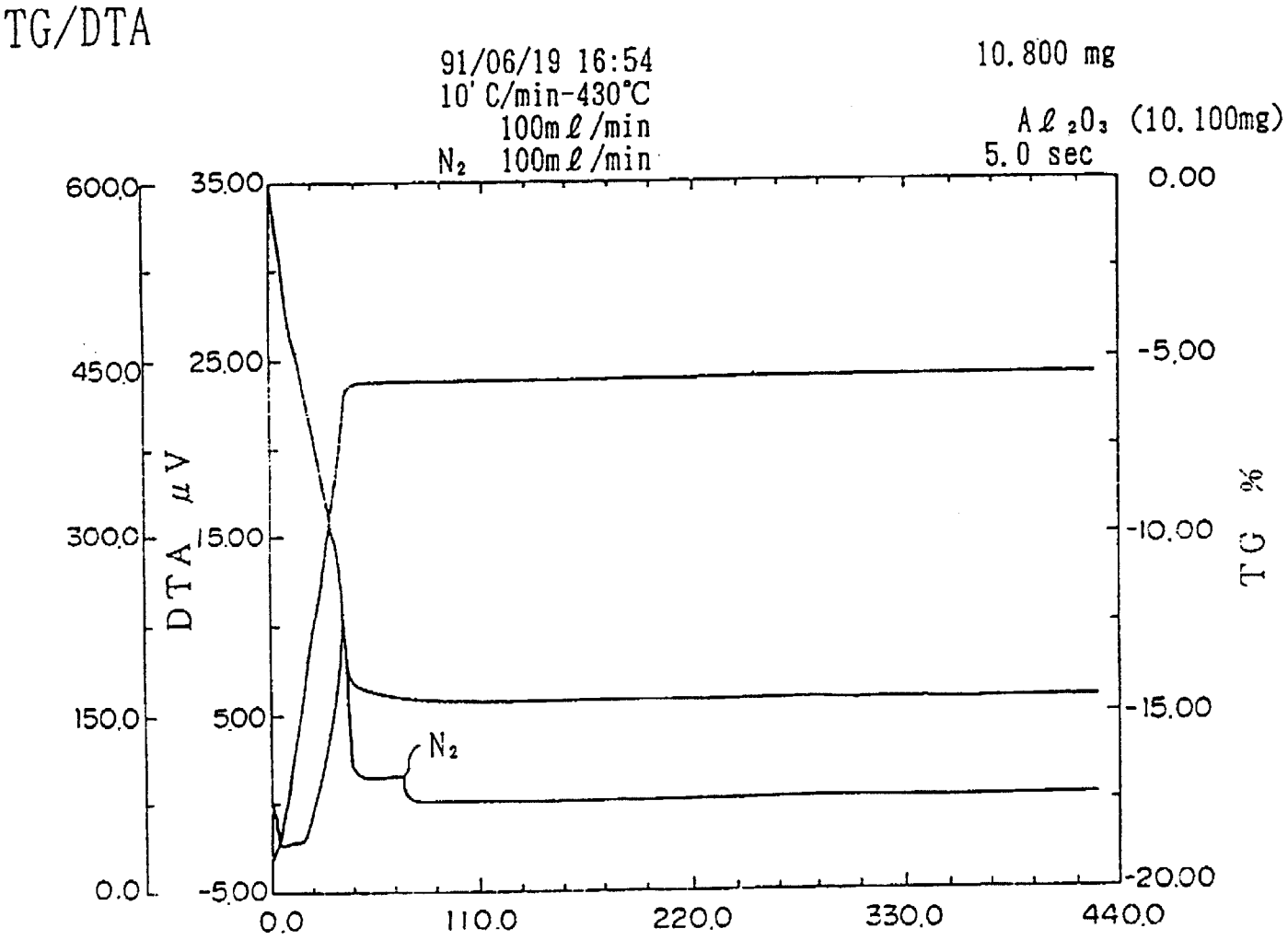
FIG. 7 shows the rates of degasification or the rates of gas evolution, determined by thermo-gravimetric analysis, of a coating composition in accordance with this invention (Composition 1 in Table 2).
Figure 8:
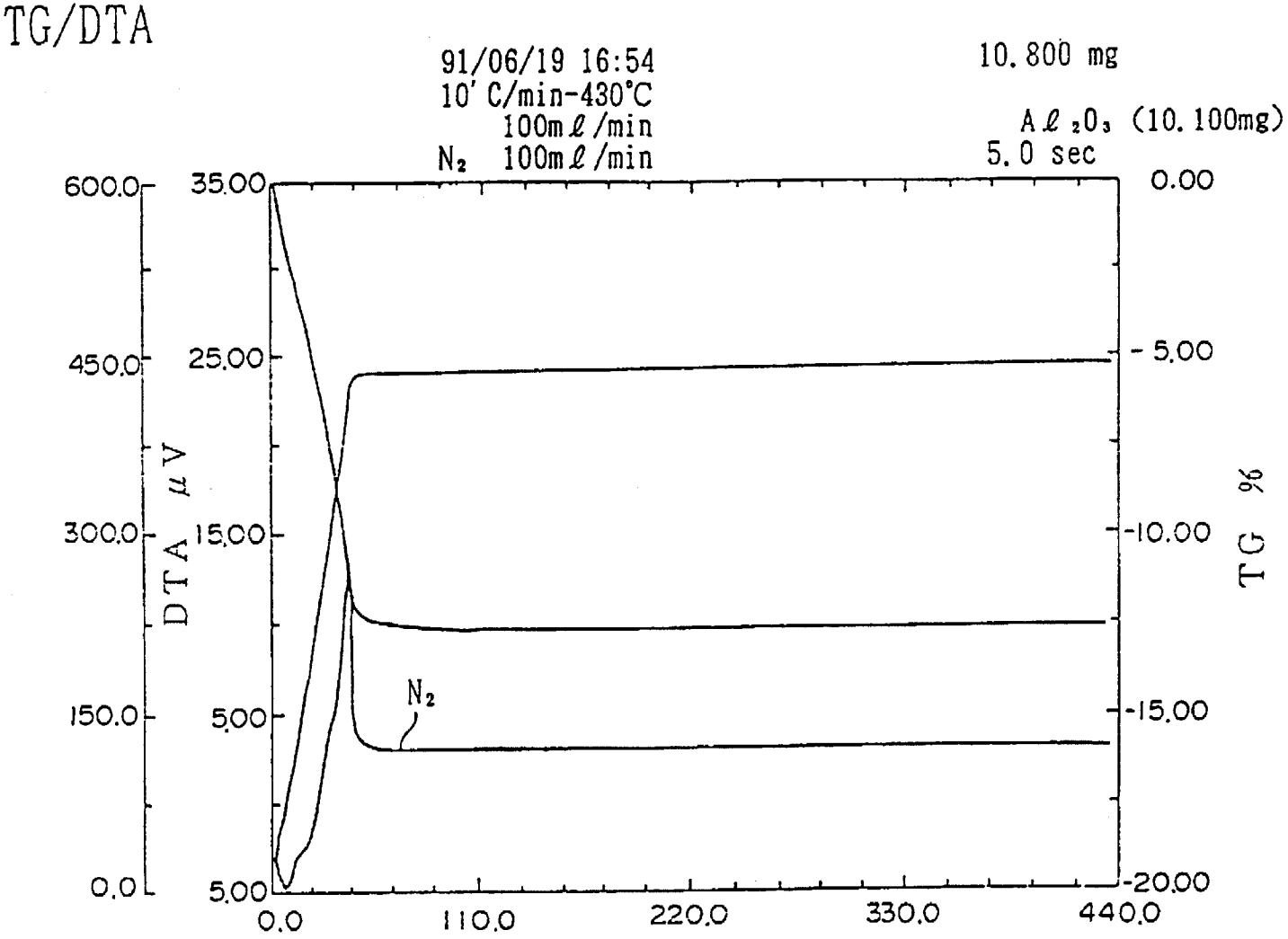
FIG. 8 shows the rates of degasification or the rates of gas evolution, determined by thermo-gravimetric analysis, of another coating composition in accordance with this invention (Composition h in Table 2).

TGA curves of selected products are shown in FIGS. 6–8 and the degasification rates are tabulated in Table 4.

Sample (A): Commercially available normal resistance internal coating which is based on potassium water glass. (FIG. 6).

Sample (B): Formulation I in Table 2. (FIG. 7).

Sample (C): Formulation h in Table 1. (FIG. 8).

Since the organic content of the composition is less than 0.3%, the loss in weight shown in Table 4 during the temperature rise from chamber temperature to 430° C. can be regarded as the evaporation of water. The drying rates of Sample (B) and (C) are very much greater than that of Sample (A). The loss in weight after switching to $N_2$ is due to the evaporation of residual water, evaporation of water by the dehydration reaction of water glass, and the generation of gas formed from the decomposition of organic dispersants. The amount of gas generated from Sample (B) or (C) is less than 12 to 19% of that from Sample (A). This is because Sample (B) or (C) do not contain water glass or organic dispersants.

The results of Experiment 4 were in good agreement, within experimental error, with the test results which were obtained by determining the amounts of gaseous materials in terms of μA which were present in special monochromatic cathode ray tubes, the insides of which were coated either with Sample (A) or with Sample (B).

TABLE 1

Ratios of Alumina Sol (Solid)/Graphites And Electric Conductivities

| Composition No. | a | b | c | d | e | f | g | h | i | j |
|---|---|---|---|---|---|---|---|---|---|---|
| Alumina Sol 200 Graphite | 0.28 | 0.32 | 0.38 | 0.49 | 0.61 | 0.69 | 0.80 | 1.00 | 1.09 | 1.20 |
| Viscosity (CPS) | 2300 | 1300 | 990 | 182 | 140 | 108 | 88 | 92 | 85 | 80 |
| Elec. Resistance (Ohms-cm) | 0.09 | 0.10 | 0.20 | 0.17 | 0.28 | 0.60 | 0.80 | 1.23 | 3.48 | 8.5 |
| Solid Content (%) | 24.5 | 22.7 | 20.0 | 24.9 | 22.4 | 21.2 | 20.0 | 18.1 | 17.5 | 16.9 |

TABLE 2

Coating Compositions Manufactured By Using Graphite, Alumina Sol

| Composition No. | k | l | k' | l' |
|---|---|---|---|---|
| Alumina Sol 200 | 0.32 | 0.37 | 0.32 | 0.37 |
| Graphite Viscosity (CPS) | 3790 | 1500 | 2675 | 1925 |
| Elec. Resistance (Ohms-cm) | 0.23 | 0.25 | 0.19 | 0.23 |
| Solids Content (%) | 26.7 | 25.0 | 28.2 | 26.5 |
| Formulations | | | | |
| Graphite | 17.0 | 15.0 | 17.0 | 15.0 |
| Alumina Sol 200 (As 10% Solid) | 54.4 | 55.0 | 54.4 | 55.0 |
| Silica Sol (As 20% Solid) | — | — | 28.6 | 30.0 |
| Silica Sol Snowtex OUP (As 15% Solid) [acidic chaining silica sol (see FIG. 2a)] | 28.6 | 30.0 | — | — |
| Total | 100.0 | 100.0 | 100.0 | 100.0 |

TABLE 3

Values Of Electrical Resistance (Ω)

| Neck Coating Used (Containing Graphite And Potassium Water Glass) | A | B | C | D | E |
|---|---|---|---|---|---|
| 1. Silicate Particles Added | 323 | 149 | 280 | 280 | 150 |
| 2. Silicon Carbide Added | 395 | 750 | 570 | 600 | 550 |
| 3. $Fe_2O_3$ | 400 | 250 | 380 | 380 | 280 |
| 4. $TiO_2$ Added | 280 | 660 | 415 | 510 | 410 |

TABLE 4

| SAMPLE NOS. | Weight Reduction While Temperature Is Raised To 430° C. Total Weight Loss (%) | Weight Reduction Between Time Reached 430° C. And Time When Air Switched to $N_2$ Total Weight Loss (%) | Weight Loss After Air Switched To $N_2$ To The End Total Weight Loss (%) |
|---|---|---|---|
| A | 71.3 | 20.0 | 8.7 |
| B | 94.3 | 4.1 | 1.6 |
| C | 94.0 | 4.9 | 1.0 |

The viscosity for the new coating composition in accordance with the invention should be, broadly stated, within the range of about 30 to about 4000 cps, and preferably it is within the range of about 80 to about 2300 cps.

The ratio of alumina sol to graphite in the coating composition should broadly be within the range of about 0.1 to 3, and preferably it should be within the range of about 0.28 to about 1.2.

The electric resistance of the applied coating should broadly be within the range of about 0.05 to about 300, and preferably within the range of about 0.06 to about 10, and most suitably within the range of about 0.23 to about 0.25 (all in ohm-cm). The coating thickness should broadly be within the range of about 3 to about 50 microns.

Small amounts of other optional ingredients may also be present in the coating composition, such as one or more non-conductive materials selected from the group consisting of: iron oxide, titanium oxide, chromium oxide, silicon oxide, silicon carbide, a surface active agent, a polymeric compound, and/or a water soluble alkali metal silicate. The coating composition may also include an organic thickening agent, such as carboxyl metal cellulose. The fluid carries medium is preferably an aqueous medium primarily of water; however, it should also be understood that carrier medium or aqueous medium may also contain other ingredients such as water soluble organic solvents, e.g., alcohols, acetones, or the like.

Further examples of coating formulations prepared in accordance with the invention are as follows.

Example AI

| Raw Materials | % By Weight |
|---|---|
| Graphite Powder [09UF2(FC)] | 20.13 |
| Alumina Sol 200 | 73.83 |
| Silica MOX 80 | 6.04 |
| | 100.00 |

Example AII

| Raw Materials | % By Weight |
|---|---|
| Graphite Powder [09UF2(FC)] | 15.0 |
| Alumina Sol 200 | 55.0 |
| Silica MOX 80 | 2.25 |
| Colloidal Silica ST-OUP | 15.00 |
| Deionized Water | 12.75 |
| | 100.00 |

Characteristics of SNOWTEX Colloidal Silica ST-OUP

| | |
|---|---|
| Solids Content | Silica 15 to 16% |
| Dispersant | Deionized water |
| Moisture (wt %) | 84 to 85% |
| Averaged particle diameter (rm) | Chain 40 to 300% |
| Viscosity (at 20° C., cp) | 5 to 10% |
| Specific Gravity (at 20° C.) | 1.08 to 1.11% |
| Appearance | Clear to opalescent |
| Stability | Effective for more than 6 months |

While it will be apparent that the preferred embodiments of the invention disclosed are well calculated to fulfill the object, benefits, or advantages of the invention, it will be appreciated that the invention is susceptible to modification, variation, and change without departing from the proper scope or fair meaning of the subjoined claims.

What is claimed is:

1. An aqueous coating composition suitable for a glass surface consisting essentially of:

acidic plumous alumina sol, comprised of an aqueous sol containing amorphous alumina particles having a thickness within the range of about 20 to about 100 millimicrons and the length of said alumina particles being within the range of about 200 to about 500 millimicrons, electrically conductive graphite powder, with the pigment ratio of alumina sol to graphite being within the range of about 0.1 to about 3.0, acidic chaining silica sol, comprised of an aqueous sol, having an $SiO_2$ concentration of ½% to 40% by weight, with the sol containing amorphous colloidal silica particles dispersed in a liquid medium, and the shape of the particles is characterized in that the particles each has a particle size of from 40 to 500 millimicrons as measured by dynamic light-scattering method, and when observed with electronic microscope each have an elongated chain-like shape elongated in only one plane and having a uniform thickness in the direction of elongation within the range of from about 5 to about 40 millimicrons, and the balance being of a fluid carrier medium containing at least about 1.65% by weight water, said coating composition having a viscosity within the range of about 30 to about 4000 cps.

2. The invention of claim 1 wherein, said coating composition is applied at a thickness of about 3 to about 50 microns, and provides an electric resistance of about 0.05 to about 300 ohm-cm.

3. The invention of claim 1 wherein, said viscosity is within the range of about 80 to about 2300 cps.

4. The invention of claim 1 wherein, the acidic plumous alumina sol and the acidic chaining silica sol act as binder materials for the coating.

5. A cathode ray tube with a part of the inner surface thereof coated with the composition of claim 4 wherein the coating composition is applied at a thickness of about 3 to about 50 microns, and provides an electric resistance of about 0.05 to about 300 ohm-cm.

6. A cathode ray tube with a part of the inner surface thereof coated with the composition of claim 4, wherein said composition provides an electric resistance of about 0.05 to about 300 ohm-cm.

* * * * *